United States Patent [19]

Morita et al.

[11] 4,319,452

[45] Mar. 16, 1982

[54] SECONDARY AIR SUPPLY DEVICE

[75] Inventors: Hideo Morita, Yokohama; Yoshio Iwasa, Nagareyama, both of Japan

[73] Assignee: Nissan Motor Company, Limited, Yokohama, Japan

[21] Appl. No.: 72,927

[22] Filed: Sep. 6, 1979

[30] Foreign Application Priority Data

Sep. 12, 1978 [JP] Japan ..... 53/125262[U]
Dec. 21, 1978 [JP] Japan ..... 53/177236[U]

[51] Int. Cl.[3] ..... F01N 3/10
[52] U.S. Cl. ..... 60/293; 137/512.15
[58] Field of Search ..... 60/293; 137/512.15

[56] References Cited

U.S. PATENT DOCUMENTS

| | | | |
|---|---|---|---|
| 1,188,969 | 6/1916 | Meister | 137/512.15 |
| 1,614,124 | 1/1927 | Hansen | 137/512.15 |
| 3,662,541 | 5/1972 | Sawada | 60/293 |
| 4,083,184 | 4/1978 | Ushijima | 60/293 |
| 4,134,263 | 1/1979 | Matsumoto | 60/293 |
| 4,162,613 | 7/1979 | Tamura | 60/293 |
| 4,179,883 | 12/1979 | Nishiyama | 60/293 |

*Primary Examiner*—Douglas Hart
*Attorney, Agent, or Firm*—Schwartz, Jeffery, Schwaab, Mack, Blumenthal & Koch

[57] ABSTRACT

A secondary air supply device including a reed valve arranged in a secondary air passage for supplying a secondary air into an exhaust gas passage of an engine through a secondary air cleaner which is provided separately from an intake air cleaner to shorten the secondary air passage as much as possible, comprises two expansion chambers in the secondary air cleaner defined by a cup-shaped support for a casing of the cleaner and a silencer along air cleaner elements and an outer wall of the cleaner, thereby effectively prevent noise by supplying the secondary air through the silencer, the air cleaner elements, the two expansion chambers and the reed valve.

The reed valve comprises a base member having radially arranged sector openings, valve seats of an elastic material on peripheries of the openings of the base member, reed valve member having unitary formed radially arranged sector valve member parts corresponding to the openings of the base member, a stopper having integrally formed radially arranged sector stopper parts for limiting lifts of the valve member parts, and a plurality of set screws for fixing the stopper and the reed valve member to the base member, thereby more effectively preventing the noise and improving the durability of the device.

11 Claims, 9 Drawing Figures

SECONDARY AIR SUPPLY DEVICE

BACKGROUND OF THE INVENTION

1. Field of the Invention

The present invention relates to a secondary air supply device for supplying secondary air with the aid of pulsations in exhaust gases in order to promote further burning of HC, CO and the like in an exhaust gas system of an engine, which is particularly capable of preventing a noise in a secondary air passage upstream of a reed valve for controlling the secondary air flow and more particularly to a reed valve suitable for use in such a secondary air supply device.

2. Description of the Prior Art

In secondary air supply devices utilizing pulsations in exhaust gases, opening and closing operations of reed valves generally cause great noises. These noises are caused by (1) periodical movements of valve members every discharging of the exhaust gases from engine, (2) impacts and transmission thereof when the valve members sit on valve seats and (3) rapid changes in pressure of the secondary air resulting from the closing and opening of the valve members.

In order to prevent the noise it has been suggested to cause the secondary air to flow through an air cleaner for an engine so as to silence the noise in the air cleaner. Since, however, the air cleaner for the engine is generally remote from an exhaust tube, a secondary air passage is unavoidably elongated to increase its intake resistance and complicate its piping which necessarily make the device expensive.

With a conventional reed valve including a plurality of reed valve members, required numbers of component parts of the valve are prepared and respective valve members are arranged independently or in series in either event that the reed valve members are separately arranged or bodily united. Such a reed valve becomes bulky and heavy and expensive to manufacture due to an increase of the number of parts with complicated secondary air supply piping and further makes a noise when the valve members are opened and closed.

In order to solve this problem, it has been proposed to arrange the valve members radially. With this arrangement, as the valve member is centrally fixed by means of only one set screw, the membraneous valve member is likely to deform at its bottom resulting in an incomplete contact between the valve member and a valve seat. The valve member is apt to rotate when being subjected to vibrations, with the result that upstream and downstream sides of the valve seat are always communicated with each other. In addition to these problems in durability, a stopper is of a circular thick configuration to increase its weight and its continuous wide curved surface increases the flow resistance because the secondary air which has passed through the valve member would impinges against the wide curved surface of the stopper.

For the purpose of solving these problems it has been considered to make large a reed valve member. A large-sized reed valve member in the form of a cantilever, however, has a low resonance frequency (for example, 140 Hz) which adversely affects its durability in use and air flow characteristics. Moreover, when a great quantity of air flow passes through a reed valve having a single valve member, its lift becomes longer to cause impacts between the valve member and its valve seat giving rise to the problem of noise. In view of these facts, with a single reed valve member it is disadvantageous to aim to obtain a great quantity of secondary air flow.

SUMMARY OF THE INVENTION

It is an object of the invention to provide an improved secondary air supply device which overcomes the disadvantages and solves the problems in the prior art.

It is another object of the invention to provide a secondary air supply device which comprises an air cleaner for secondary air separate from an air cleaner for an engine to shorten a secondary air passage as much as possible and the secondary air cleaner includes a plurality of expansion chambers and a silencer along an outer wall of the cleaner on unpurified secondary air side, thereby effectively silencing noise by means of the silencer, the expansion chambers and air cleaner elements.

It is further object of the invention to provide a secondary air supply device which is small, compact and light in weight with minimum number of parts and durable and silent in use and which is also suitable for a great quantity of secondary air.

To accomplish these objects the secondary air supply device including a reed valve arranged in a secondary air passage communicating an air cleaner for a secondary air with an exhaust gas passage for supplying the secondary air through said air cleaner into said exhaust gas passage according to the invention comprises two expansion chambers in said air cleaner defined by a support for said reed valve and a silencer arranged along air cleaner elements and an outer wall of the air cleaner on unpurified secondary air side, thereby supplying said secondary air through said silencer, said air cleaner elements, said two expansion chambers and said reed valve.

In another aspect, the device according to the invention includes the reed valve which comprises a reed valve casing forming a part of said unitary casing and having an inlet and an outlet, a base member received in said reed valve casing and having radially arranged sector openings, valve seats of an elastic material located on peripheries of said openings of said base member, a reed valve member having radially arranged unitary sector valve member parts corresponding to said radially arranged openings of said base member and brought to be in and out of contact with said valve seats, a stopper having radially arranged unitary sector stopper parts for limiting lifts of said valve member parts, and a plurality of fastening means for fixing said stopper and said reed valve member to said base member.

In order that the invention may be more clearly understood, preferred embodiments will be described, by way of example, with reference to the accompanying drawings.

DETAILED DESCRIPTION OF THE PREFERRED EMBODIMENT

Figure 1:
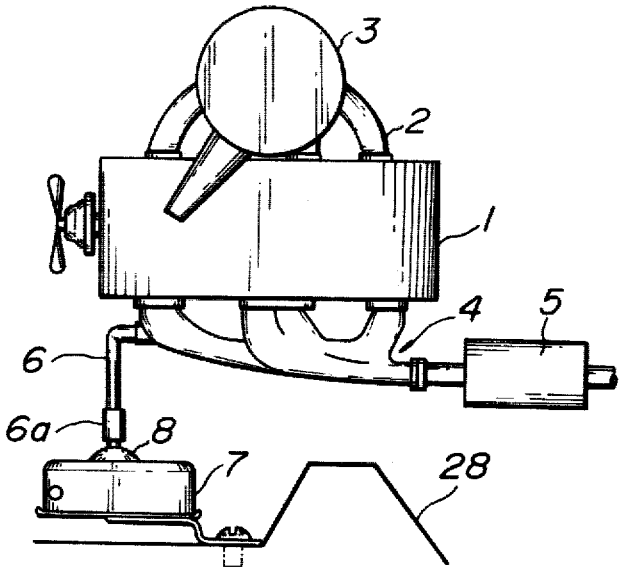
FIG. 1 is a diagrammatic plan view of an engine equipped with the device according to the invention.

FIG. 1 illustrates an engine provided with a secondary air supply device according to the invention, which engine comprises an engine body 1, an intake duct 2, an air cleaner 3 for the engine, an exhaust manifold 4, a catalytic converter 5 for purifying an exhaust gas arranged downstream of the exhaust manifold 4, a secondary air passage 6 connected to the manifold 4 upstream of the catalytic converter 5, an air cleaner 7 for a secondary air, and a reed valve 8 for controlling the secondary air supply, which is provided on the air cleaner 7 for the secondary air. The reed valve assembly 8 includes an air outlet 16 connected to the secondary air passage 6 through a rubber hose 6*a* for introducing the secondary air which has purified in the air cleaner 7 and controlled by the reed valve 8 through the secondary air passage 6 into the exhaust manifold 4 upstream of the catalytic converter 5 for promoting the oxidizing reaction of HC and CO in the converter 5.

Figure 2:
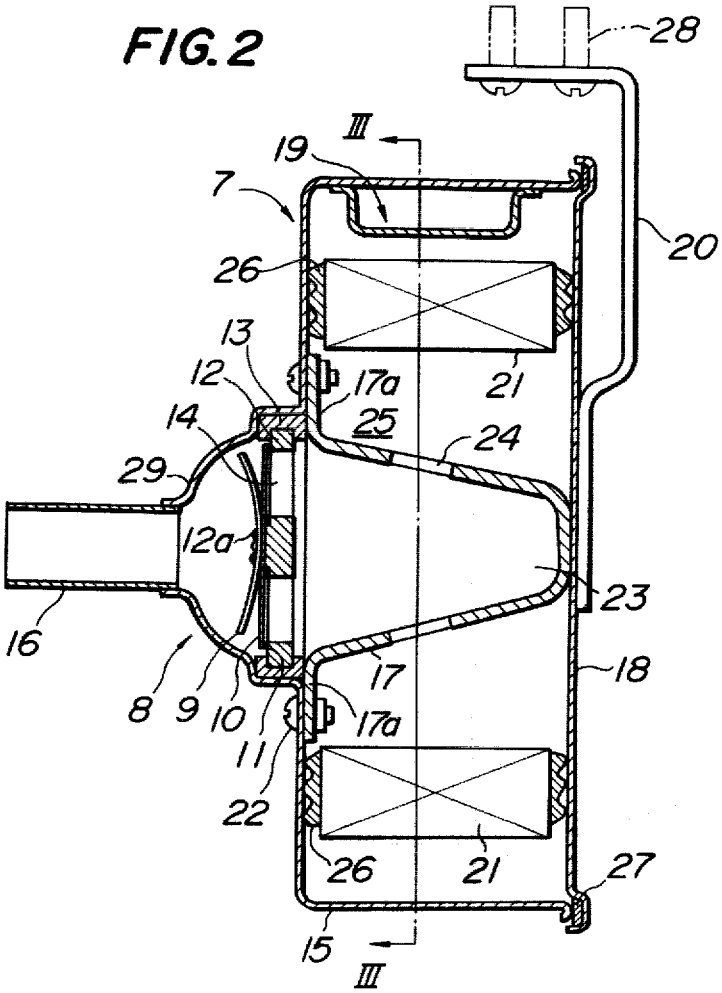
FIG. 2 is a sectional view of one embodiment of the device according to the invention.
Figure 3:
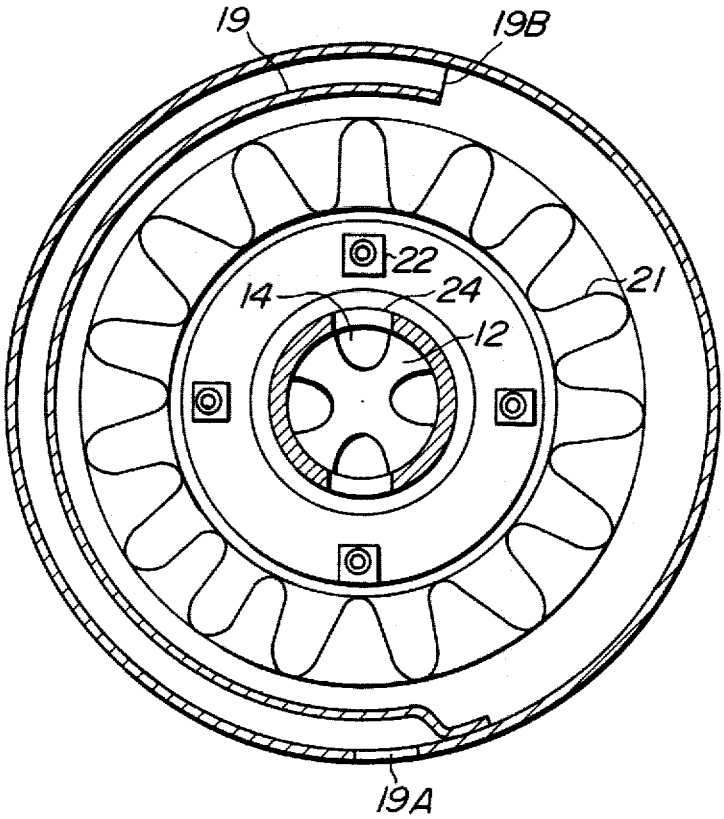
FIG. 3 is a sectional view of the device taken along the line III—III in FIG. 2.

FIGS. 2 and 3 illustrate the air cleaner 7 for the secondary air and the reed valve 8 arranged thereon in detail. A casing 15 of the air cleaner 7 and a casing 29 of the reed valve 8 are made of, for example, a plastic material integrally molded. In this embodiment, the air outlet 16 is separately molded and secured to the casing 29. The air outlet 16 may be integrally molded in the casing.

The reed valve 8 comprises in the casing 29 a reed valve stopper 9 and a reed valve 10 which are together clamped to a base member 12 by means of set screws 12*a*. The reed valve member 10 is closed and opened by pulsations in exhaust gases in the exhaust manifold 4 transmitted through the secondary air passage 6. When the reed valve member 10 is opened, the secondary air purified in air cleaner elements 21 is introduced through openings 14 of the base member 12 into the secondary air passage 6. Valve seats 11 at edges of the openings 14, against which the periphery of the reed valve member 10 abuts, are preferably made of a sound proof material for absorbing impact sounds of the reed valve member 10 against the base member 12 as much as possible. Between the casing 29 and the periphery of the base member 12 is interposed a sealing member 13 to seal therebetween in an air-tight manner.

A cover 18 for the casing 15 of the secondary air cleaner 7 is centrally provided on its inside with a cup-shaped support 17 securely fixed thereto. The cup-shaped support 17 is formed in its circumferential wall with a plurality of openings 24 and includes an end flange 17*a* fixed by means of screws 22 to an inside of a bottom wall of the casing 15 to which is fixed the casing 29 of the reed valve 8 to divide the inside of the casing 15 into two expansion chambers 23 and 25. The base member 12 of the reed valve 8 and the air cleaner elements 21 are held through the respective sealing members 13 and 26 by the support 17 and cover 18, thereby minimizing the number of the parts without using particular parts for assembling the device. The holding of the components with the interposed elastic sealing members 13 and 26 also serves to accommodate errors in assembling the device. A reference numeral 27 illustrates a sealing member interposed between the casing 15 and the periphery of the cover 18.

With this arrangement a great silencing effect can be achieved by the two series expansion chambers 23 and 25 in the casing 15 communicating with each other through the openings 24 and the multiple sound proof wall construction consisting of the casing 15, air cleaner elements 21 and wall of the support 17. In addition, along an outer circumference of the casing 15 on the side of unpurified secondary air is arranged a silencer 19 having openings 19A and 19B respectively on the sides of atmosphere and the cleaner elements thereby to more improve the silencing effect. By arranging the silencer 19 along the circumference of the casing on the unpurified air side as above described it becomes easy to examine the configuration in a longitudinal direction to achieve a sufficient sound proof over a wide range from low frequencies to high frequencies of the sound.

A bracket 20 is fixed to the outside of the cover 18 for mounting the air cleaner 7 for the secondary air on a vehicle body wall 28 of an engine room. The air cleaner 7 is mounted on the vehicle body wall 28 in this manner to prevent the cleaner 7 from being directly subjected to vibrations of an engine, thereby improving the durability of the cleaner 7.

Figure 4:
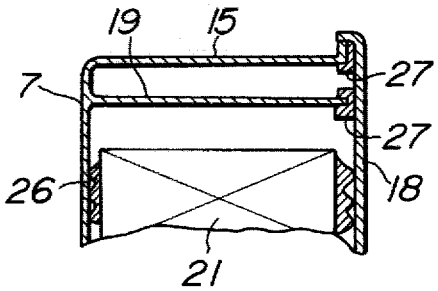
FIG. 4 is a partial sectional view showing one embodiment of the silencer used in the device according to the invention.
Figure 5:
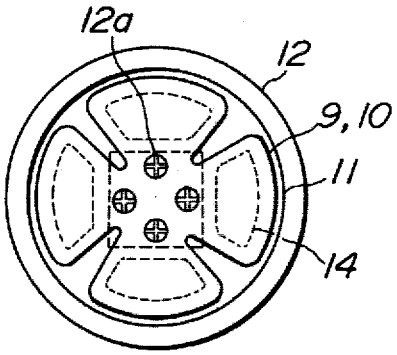
FIG. 5 is a plan view of main parts of a reed valve used in the device according to the invention.
Figure 6:
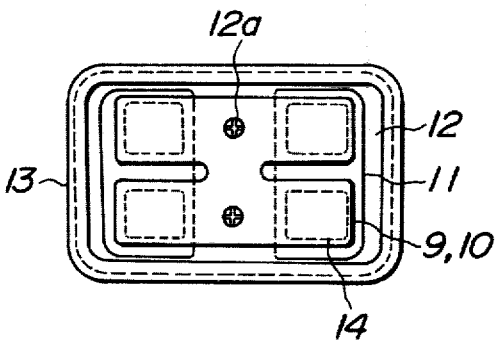
FIG. 6 is a plan view similar to FIG. 5 but illustrating main parts of another reed valve used in the device according to the invention.

The silencer 19 may be integrally formed with the casing 15 as shown in FIG. 4. As shown in FIGS. 5 and 6 illustrating one example of the main parts of the reed valve, a plurality of openings 14 is formed in the base member 12 of the reed valve 8, and the reed valve member 10 and stopper 9 are formed in symmetry and united at their centers, thereby enabling the openings to be larger relative to the area of the base member 12 and enabling the reed valve to be smaller, with the result that the secondary air can be relatively increased and the sounds due to vibrations of the reed valve can be minimized by the much higher resonance frequency of the reed valve. Such effects will be explained in more detail referring to FIGS. 7-9.

With the embodiment shown in FIG. 5, the base member 12 is formed with four sector openings and the reed valve member 10 and stopper 9 correspondingly include four reed valve member parts and four stopper parts in the form of sectors, respectively. Such configurations will be explained in more detail referring to FIGS. 7-9.

With the embodiment shown in FIG. 6, the base member 12 is rectangular having four substantially rectangular openings, and the reed valve member 10 includes two pair of unitary rectangular valve member parts corresponding to the rectangular openings of the base member. The two pair of valve member parts are connected by an integral narrowed portion of the valve member. The stopper 9 includes two pairs of unitary rectangular stopper parts.

Figure 7:
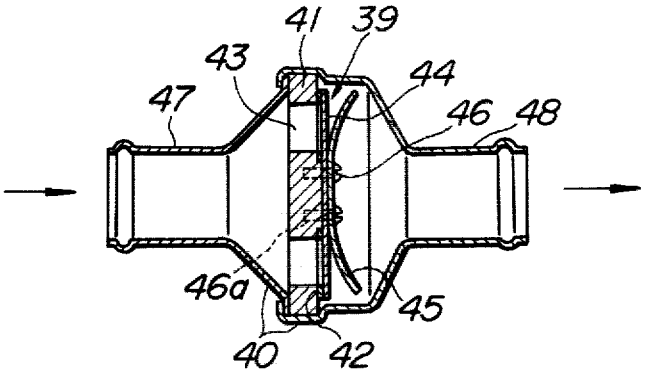
FIG. 7 is a sectional view of further embodiment of the reed valve used in the device according to the invention.
Figure 8:
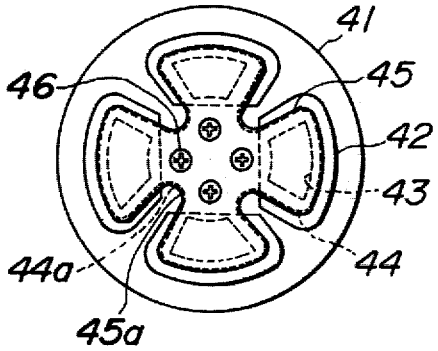
FIG. 8 is a plan view of main parts of the reed valve shown in FIG. 7.
Figure 9:
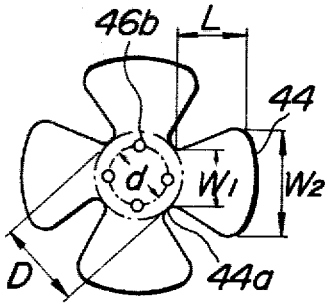
FIG. 9 is a plan view of a reed valve member of the reed valve shown in FIG. 7.

FIGS. 7-9 illustrate another embodiment of the reed valve used in the device according to the invention, which comprises a casing 40 consisting of two parts, a base member 41 made of an aluminum alloy or the like, seat members 42 of a sound proof material, openings 43, a reed valve member 44 made of a stainless steel in the form of radially extending sectors divided by recesses or bays 44a, set screws 46 having screw threads 46a screwed in threaded apertures 46b formed in the base member 42, and a stopper 45 for the reed valve member. The main valve components 41, 42, 44 and 45 are held in the casing 40 which forms an inlet 47 and an outlet 48 and sealingly holds the base member 41 by clenching its periphery thereto.

FIG. 8 illustrates the main components of the reed valve. The circular base member 41 is formed with the openings 43 in the form of a sector radially extending from the center of the base member. The seat members 42 in the form of a similar sector arranged around the sector openings 43 are made of an elastic material such as a rubber for sealing and sound proof effects in operation. The reed valve member 44 is a unitary plate having a configuration corresponding to the oepnings 43 and includes recesses or bays 44a to separate the plate into four valve member parts capable of independently operating thereby improving the durability of the reed valve. The thickness of the reed valve member 44 is 0.15–0.35 mm, preferably 0.2–0.3 mm for its operating characteristics. The stopper 45 serves to limit the maximum lift of the reed valve member and is a unitary plate having recesses or bays 45a to separate it into four radially extending sector stopper members similar to the reed valve member 44, which configurations serves to make light the device as a whole. The reed valve member and stopper are clamped to the base member by means of the plurality of the set screws 46 screwed through apertures 46b of the reed valve member into the threaded apertures 46a of the base member 41. The reed valve constructed as above described according to the invention is compact in configuration with a minimum number of parts although it includes a plurality of valve openings, and therefore easy and inexpensive to manufacture and light weight.

The reed valve of this embodiment including the plurality of the openings 13 is able to supply a great quantity of air flow with ease and generates less noise in operation because of the small lift of the valve portions by the fact that the air flow is distributed to the respective valve openings. In this case, the valve part is in the form of a sector which is capable of achieving by a smaller length L (FIG. 9) of the valve the same opened area of the valve as that would otherwise be the case, so that the resonance frequency of the valve will become higher because of the smaller length of the valve to improve the durability of the valve. In other words, openings can be effectively formed in a base member having the same size. Moreover, the reed valve member part can be small-sized to make higher its resonance frequency (for example, approximately 180–300 Hz), which would become insusceptible to vibrations from the engine to improve its operative characteristics and sealing faculties.

With the sector-shaped reed valve member part, a ratio of an average length $L_v$ to an average width $W_v$ of the reed valve member part is 0.5–2.0, preferably 0.7–1.5, where $W_v=(W_1+W_2)/2$ and $W_1$ and $W_2$ are widths of the reed valve at the bottom and top, respectively (FIG. 9). When a circular base member is provided with a plurality of openings as large as possible, a great quantity of the secondary air can be supplied by the small and light weight reed valve which has necessarily a high resonance frequency.

In the embodiment, a ratio D/d of a diameter D at the recess 44a to a diameter d at the set screws is 1.0–20. With this arrangement, a sufficiently rigid holding for the reed valve member is obtained even at the width $W_1$ of the bottom of the valve member part, and the set screws as supports are possibly near the bottoms of the valve member parts, thereby reducing stresses acting upon the recesses 14a to improve the durability of the reed valve.

As the reed valve member and stopper are fixed in the proximities of their centers of gravity to the base member by means of the plurality of set screws, they are securely held without affecting by vibrations from the engine to prevent the reed valve member from being rotated. Accordingly, even if the reed valve is directly secured to the engine, it exhibits the superior durability without being damaged, cracked or other failed. Moreover, as the load from the reed valve member acts on the proximity of the center of the base member, it is never rotated in the casing by the action of vibrations or the like even if it is circular, and therefore any leakage of the exhaust gas between the casing and the base member can be reliably prevented. In this embodiment, the reed valve member is fixed to the base member by means of the four set screws and includes the valve member parts united at the center in a circle in which the set screws are arranged, so that the reed valve member and base member are securely fixed to each other to obtain a flatness of the reed valve easily and to improve the sealing faculty for preventing any leakage between the reed valve member and valve seats.

Furthermore, the secondary air is introduced through the valve member 44 and the recesses or bays 45a of the stopper 45 to reduce the flow resistance, thereby supplying a sufficient quantity of the secondary air flow. The negative pressure owing to the pulsations in the exhaust gas acts upon the reed valve member 44 through the recesses 45a of the stopper 45 to improve the responsibility of the valve for closing and opening.

The secondary air supply device with the air cleaner for the secondary air provided separately from the air cleaner for an engine according to the invention enables the seconeary air cleaner to arrange at any position near an exhaust manifold with a shorter secondary air piping, thereby minimizing the exhaust gas pulsation losses and intake resistances to increase the quantity of the secondary air. Moreover, the provision of a plurality of communicated expansion chambers in the secondary air cleaner divided by the support, and the provision of the silencer along the outer wall of the cleaner on the unpurified air side and the multiple sound proof wall construction consisting of the air cleaner casing, air cleaner elements and support wall according to the invention provide the improved silencing effect for effectively silencing sounds due to vibrations of the reed valve member, sitting of the valve against the valve seat and change in pressure of the secondary air.

The reed valve having a plurality of sector valve member parts radially extending according to the invention exhibits a superior characteristic over a wide range from small to large quantities of air flow which is advantageous for controlling the exhaust gas components. The reed valve member having a plurality of sector valve member parts radially extending can be small-sized to obtain its higher resonance frequency which enables the lifting characteristics of the valve to be insusceptible to the vibrations of an engine and the variations in air flow to improve its accuracy and durability. At the same time, the air flow is distributed to the plurality of the valve member parts to decrease respective lifts of the valve members, thereby minimizing the noise when the valve is operated.

It is further understood by those skilled in the art that the foregoing description is preferred embodiments of the disclosed devices and that various changes and modifications may be made in the invention without departing from the spirit and scope thereof.

What is claimed is:

1. A secondary air supply device for supplying clean air to an exhaust gas passage, said device including:

a secondary air supply air cleaner including a cleaning element having clean air and unpurified air sides;

a secondary air passage communicating said clean air side of said air cleaner element with said exhaust gas passage;

a reed valve located in said secondary air passage;

a silencer extending at least partially around said air filter on said cleaner element unpurified air side; and means defining a chamber on said air cleaner element clean air side, between said cleaner element and said reed valve, said chamber means comprising two expansion chambers, said device thereby supplying said secondary air through said silencer, said air cleaner element, said two expansion chambers and said reed valve to said exhaust gas passage, wherein said air cleaner for the secondary air comprises: a unitary casing means for receiving said reed valve and said cleaner element therein and for forming said expansion chambers; a cover for the casing; and a reed valve support, said support having one end fixed to said casing for holding said reed valve and the other end fixed to said cover for holding said cleaner element to form said two expansion chambers, and said silencer forming a tubular passage along an inner circumferential surface of an outer wall of said air cleaner on unpurified secondary air side.

2. A secondary air supply device as set forth in claim 1, wherein said support is a cup-shaped support whose bottom is fixed to said cover and an open end is fixed to said casing and whose circumferential wall is formed with a plurality of openings communicating said two expansion chambers divided by said wall of the support.

3. A secondary air supply device as set forth in claim 1, wherein said reed valve comprises: a reed valve casing forming a part of said unitary casing and having an inlet and an outlet; a base member received in said reed valve casing and having radially arranged sector openings, valve seats of an elastic material located on peripheries of said openings of said base members; a reed valve member having radially arranged unitary sector valve member parts corresponding to said radially arranged openings of said base member and brought to be in and out of contact with said valve seats; a stopper means, having radially arranged unitary sector stopper parts, for limiting lifts of said valve member parts; and a plurality of fastening means for fixing said stopper and said reed valve member to said base member.

4. A secondary air supply device as set forth in claim 3, wherein there are four of said sector openings of said base member, four valve seats, four sector valve member parts of said reed valve member and four sector stopper parts of said stopper.

5. A secondary air supply device as set forth in claim 3, wherein a ratio of an average length to an average width of said sector valve member parts of said reed valve member is 0.5–2.0.

6. A secondary air supply device as set forth in claim 3, wherein a ratio of an average length to an average width of said sector valve member parts of said reed valve member is 0.7–1.5.

7. A secondary air supply device as set forth in claim 3, wherein a ratio of a diameter at recesses between said sector valve member parts of said reed valve to a diameter of a circuit in which set screws as said fastening means are arranged is 1.0–2.0.

8. A secondary air supply device as set forth in claim 1, wherein said reed valve comprises: a reed valve casing having an inlet and an outlet; a rectangular base member having four substantially rectangular openings; valve seats of an elastic material located on peripheries of said openings of said base member; a reed valve member having two pairs of unitary rectangular valve member parts corresponding to said openings of said base member and brought to be in and out of contact with said valve seats, said two pairs of the parts being connected by an integral narrowed portion, a stopper means, having two pairs of unitary rectangular stopper parts, for limiting lifts of said valve member parts, and a plurality of fastening means for fixing said stopper and said reed valve member to said base member.

9. A secondary air supply device as set forth in claim 1, wherein said silencer is integrally formed with said outer wall of said air cleaner.

10. A secondary air supply device as set forth in claim 1, wherein said air cleaner element is held between said casing and said cover by means of elastic sealing members arranged therebetween.

11. A secondary air supply device as set forth in claim 3 or 9, wherein said air cleaner element is held between said casing and said cover by means of elastic sealing members arranged therebetween and said base member of said reed valve is held against by said casing by means of an elastic sealing member arranged therebetween.

* * * * *